US007073474B2

(12) United States Patent
Biel

(10) Patent No.: US 7,073,474 B2
(45) Date of Patent: Jul. 11, 2006

(54) FLYWHEEL WITH TORSIONAL DAMPENING RING

(75) Inventor: Michael J. Biel, Beaver Dam, WI (US)

(73) Assignee: BRP US Inc., Sturtevant, WI (US)

( * ) Notice: Subject to any disclaimer, the term of this patent is extended or adjusted under 35 U.S.C. 154(b) by 0 days.

(21) Appl. No.: 10/605,937

(22) Filed: Nov. 6, 2003

(65) Prior Publication Data

US 2005/0098139 A1 May 12, 2005

(51) Int. Cl.
*F02B 75/06* (2006.01)

(52) U.S. Cl. ..... 123/192.1; 74/574; 440/85

(58) Field of Classification Search ..... 123/192.1; 74/574; 440/52, 85
See application file for complete search history.

(56) References Cited

U.S. PATENT DOCUMENTS

| | | | | |
|---|---|---|---|---|
| 1,928,119 | A * | 9/1933 | Vargha | 74/574 |
| 2,060,565 | A * | 11/1936 | Geyer | 74/574 |
| 2,779,211 | A * | 1/1957 | Henrich | 74/574 |
| 3,656,599 | A | 4/1972 | Diggs | |
| 4,182,138 | A | 1/1980 | McGuire | |
| 4,198,878 | A | 4/1980 | Lewis et al. | |
| 4,638,684 | A | 1/1987 | Maucher | |
| 4,889,218 | A | 12/1989 | Chasseguet et al. | |
| 4,972,929 | A | 11/1990 | Ivers et al. | |
| 5,058,267 | A * | 10/1991 | Andra et al. | 74/574 |
| 5,083,538 | A | 1/1992 | Hubbell | |
| 5,205,788 | A | 4/1993 | Sacher et al. | |
| 5,259,347 | A | 11/1993 | Kobayashi et al. | |
| 5,282,444 | A | 2/1994 | Ito et al. | |
| 5,362,160 | A * | 11/1994 | Braun et al. | 384/549 |
| 5,380,248 | A | 1/1995 | Kraus et al. | |
| 5,485,757 | A | 1/1996 | Foxwell | |
| 5,501,434 | A | 3/1996 | McGuire | |
| 5,509,833 | A | 4/1996 | Rodskier | |
| 5,645,151 | A | 7/1997 | Linder et al. | |
| 5,669,478 | A | 9/1997 | Schierling et al. | |
| 5,688,152 | A | 11/1997 | Rodskier | |
| 5,704,839 | A | 1/1998 | Michael et al. | |
| 5,735,718 | A | 4/1998 | Ekwall | |
| 5,954,169 | A | 9/1999 | Jensen | |
| 6,019,683 | A | 2/2000 | Sudau | |
| 6,077,135 | A | 6/2000 | Ito | |
| 6,123,518 | A | 9/2000 | Zakula, Sr. et al. | |
| 6,186,290 | B1 | 2/2001 | Carlson | |
| 6,192,851 | B1 * | 2/2001 | Asahara et al. | 123/192.2 |
| 6,200,222 | B1 | 3/2001 | Sudau | |
| 6,234,905 | B1 | 5/2001 | Gwinn et al. | |
| 6,293,234 | B1 | 9/2001 | David | |

(Continued)

FOREIGN PATENT DOCUMENTS

| | | | |
|---|---|---|---|
| DE | 2840485 A | * | 3/1980 |
| JP | 08042637 A | * | 2/1996 |

*Primary Examiner*—Noah P. Kamen
(74) *Attorney, Agent, or Firm*—Osler, Hoskin & Harcourt LLP

(57) ABSTRACT

An apparatus and method for constructing a flywheel assembly is disclosed. The flywheel assembly includes a flywheel hub that is constructed to engage a crankshaft of an internal combustion engine. A ferrous ring is attached to the flywheel hub with an elastomer ring positioned therebetween. The elastomer ring isolates the ferrous ring from the flywheel hub such that the ferrous ring resonates at a frequency that substantially reduces the amplitude of the resonance of the crankshaft and flywheel. Such a construction effectively dampens the torsional resonance of the engine and provides for smoother operation.

22 Claims, 2 Drawing Sheets

U.S. PATENT DOCUMENTS 6,328,004 B1 12/2001 Rynhart
6,652,334 B1 * 11/2003 Kusche et al. ..... 440/52
2001/0040326 A1 11/2001 Balczun et al.
2002/0079630 A1 6/2002 Bachmeyer et al.

* cited by examiner

FLYWHEEL WITH TORSIONAL DAMPENING RING

BACKGROUND OF INVENTION

The present invention relates generally to internal combustion engines and, more particularly, to a flywheel for use therewith.

In both two-cycle and four-cycle engines, a flywheel attached to an end of the crankshaft equalizes operation of the engine between combustion and compression strokes. The momentum absorbed by the flywheel during the combustion stroke is expended during subsequent strokes. Such an orientation smoothes out engine speed and maintains crankshaft momentum between power strokes.

The crankshaft of the engine undergoes torsional loading by both the connecting rods and the flywheel. As the connecting rod of the piston exerts force on the respective throw of the crankshaft, the mass of the flywheel tends to resist such a rotation. After the combustion stroke, the flywheel exerts a rotational moment on the crankshaft in order to facilitate the compression of the combustion gases in the cylinder. If the operating frequency of the engine matches a natural resonant frequency of the crankshaft, violent vibration can occur.

It would therefore be desirable to have a system and method capable of dampening the torsional resonance of an internal combustion engine.

BRIEF DESCRIPTION OF INVENTION

The present invention is directed to a flywheel assembly that solves the aforementioned problems. The present invention provides an assembly for a flywheel having a center hub with a ring positioned thereabout. An elastomer isolation member is disposed between the center hub and the ring and is constructed to absorb torsional resonance generated by an engine attached thereto. The ring and the elastomer isolation member have a natural resonance that counteracts the natural resonance of the engine.

Therefore, in accordance with one aspect of the present invention, a flywheel assembly is provided that includes a hub having an inner and an outer diameter. A first ring is attached to the hub about the outer diameter with a second ring disposed therebetween. The second ring is formed of a material different from that of the first ring. Such a construction allows for the independent vibration of the first ring relative to the hub.

In accordance with another aspect of the present invention, a flywheel assembly is provided that includes a flywheel having an outer surface, a ring having an inner surface, and an elastomer ring. The elastomer ring has a first side attached to the flywheel and a second side attached to the ring, thereby separating the ring from the fly-wheel. This construction allows the ring to resonate at a frequency that counteracts a natural frequency of the fly-wheel and an engine attached thereto.

In accordance with a further aspect of the present invention, a flywheel assembly is provided that includes a ring having an inner diameter and a flywheel having an outer diameter wherein the outer diameter of the flywheel is constructed to pass through the ring. A flexible membrane is disposed between the ring and the flywheel and constructed to prevent contact therebetween. This construction allows the ring and flexible membrane to counteract a frequency of vibration of the flywheel and an engine attached thereto.

In accordance with yet another aspect of the present invention, a method of offsetting natural resonance in an internal combustion engine is provided that includes the steps of determining a natural resonance of an internal combustion engine, designing a flywheel component with a natural resonance to offset the natural resonance of the internal combustion engine, and assembling the fly-wheel component to the internal combustion engine.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

The present invention relates generally to internal combustion engines, and preferably, to two-cycle gasoline-type engines.

Figure 1:
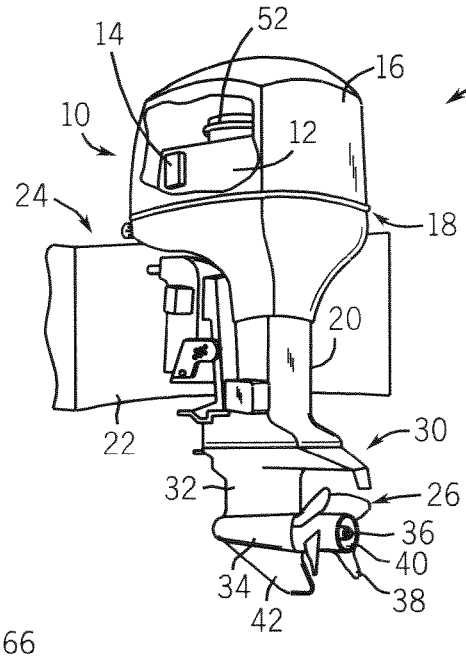
FIG. 1 is a perspective view of an exemplary outboard motor incorporating the present invention.

FIG. 1 shows an outboard motor 10 having one such engine 12 controlled by an electronic control unit (ECU) 14 under engine cover 16. Engine 12 is housed generally in a powerhead 18 and is supported on a mid-section 20 configured for mounting on a transom 22 of a boat 24 in a known conventional manner. Engine 12 is coupled to transmit power to a propeller 26 to develop thrust and propel boat 24 in a desired direction. A lower unit 30 includes a gear case 32 having a bullet or torpedo section 34 formed therein and housing a propeller shaft 36 that extends rearwardly therefrom. Propeller 26 is driven by propeller shaft 36 and includes a number of fins 38 extending outwardly from a central hub 40 through which exhaust gas from engine 12 is discharged via mid-section 20. A skeg 42 depends vertically downwardly from torpedo section 34 to protect propeller fins 38 and encourage the efficient flow of outboard motor 10 through water.

At an upper end 50 of powerhead 18, between engine 12 and cover 16, a flywheel assembly 52 is attached to engine 12. Flywheel assembly 52 is attached to a crankshaft (not shown) of engine 12 and provides engine 12 with an equalizing momentum to assist transition from one combustion cycle to the next. Additionally, flywheel assembly 52, by having a sufficient mass, smoothes the operation of engine 12. That is, during the combustion stroke of any particular piston of engine 12, a portion of the energy generated is used to rotate the flywheel assembly 52. After the combustion stroke of the particular piston, fly-wheel assembly 52 continues to rotate, and due to its mass, expends momentum previously absorbed and exerts a rotational force on the crankshaft in the same direction of rotation generated by the combustion. As such, flywheel assembly 52, to some degree, can control vibration and the speed of acceleration and deceleration of the crankshaft, thereby having an effect on the overall engine operation.

Figure 2:
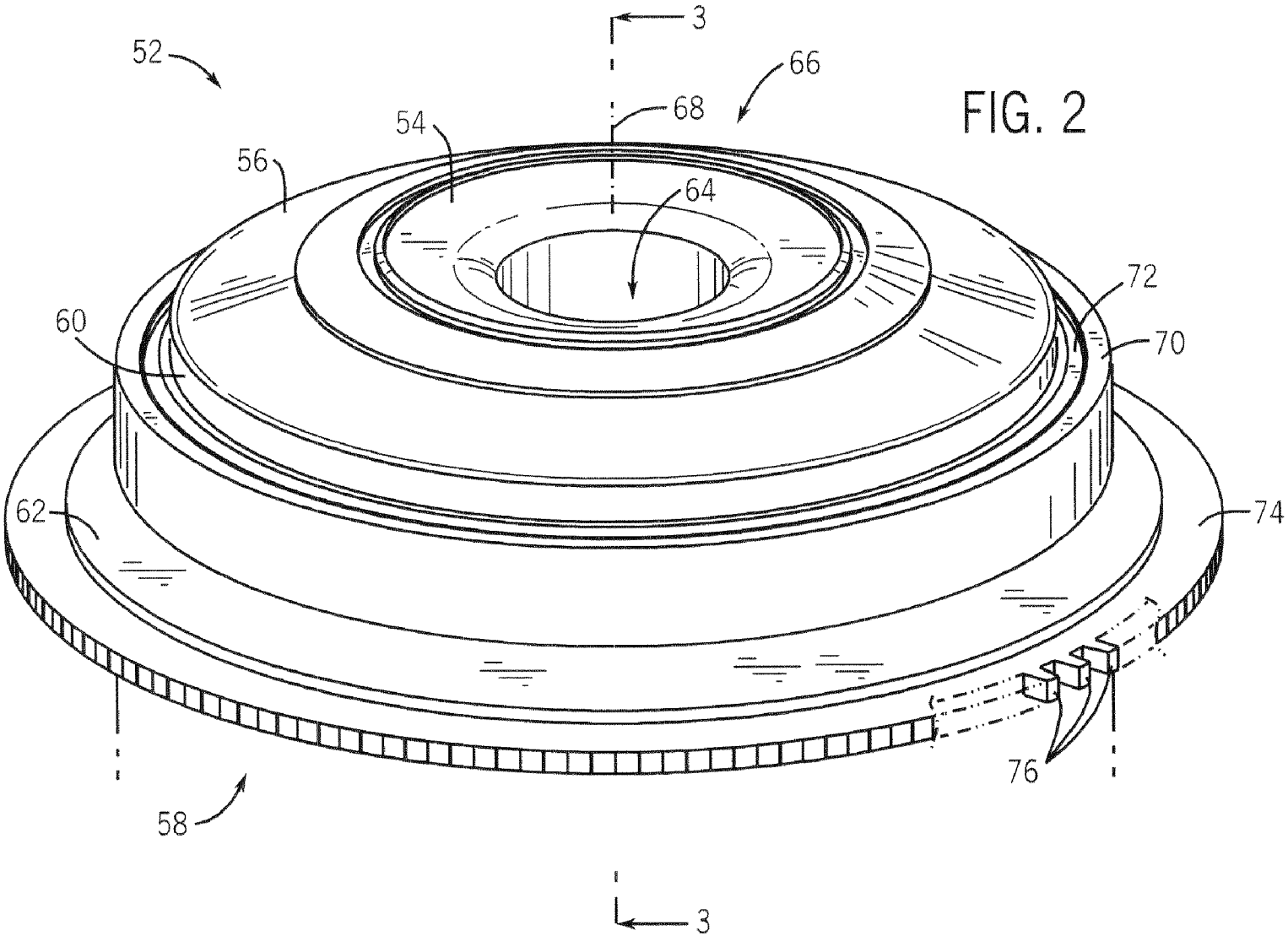
FIG. 2 is a perspective view of the flywheel of FIG. 1.

Flywheel assembly 52 is generally disc shaped, as shown in FIG. 2, and includes a flywheel 54 having an upper surface 56 and a lower surface 58. Flywheel 54 of the present invention includes an outer diameter 60 that extends between the upper and lower surfaces 56, 58 with a ridge 62 formed thereon. An opening 64 passes through a center 66 of flywheel 54 along an axis 68 thereof. Center 66 of flywheel 54 is constructed to attach to a crankshaft of an engine such that flywheel 54 rotates therewith when attached thereto.

A ring 70 extends about the outer diameter 60 of fly-wheel 54 between ridge 62 and upper surface 56. An elastomer ring 72 is disposed between ring 70 and flywheel 54 such that there is no direct contact between ring 70 and fly-wheel 54. As such, ring 70 is free to oscillate or resonate independent of flywheel 54. Additionally, elastomer ring 72 is preferably constructed such that ring 70, with elastomer ring 72 attached thereto, is press fit to flywheel 54. Ridge 62 is constructed such that a ring gear 74, having a plurality of teeth 76, may be attached thereto or formed integrally therewith. Ring gear 74 is constructed to engage a starter gear of a starter (not shown) to facilitate electronic starting of an engine attached thereto.

Figure 3:
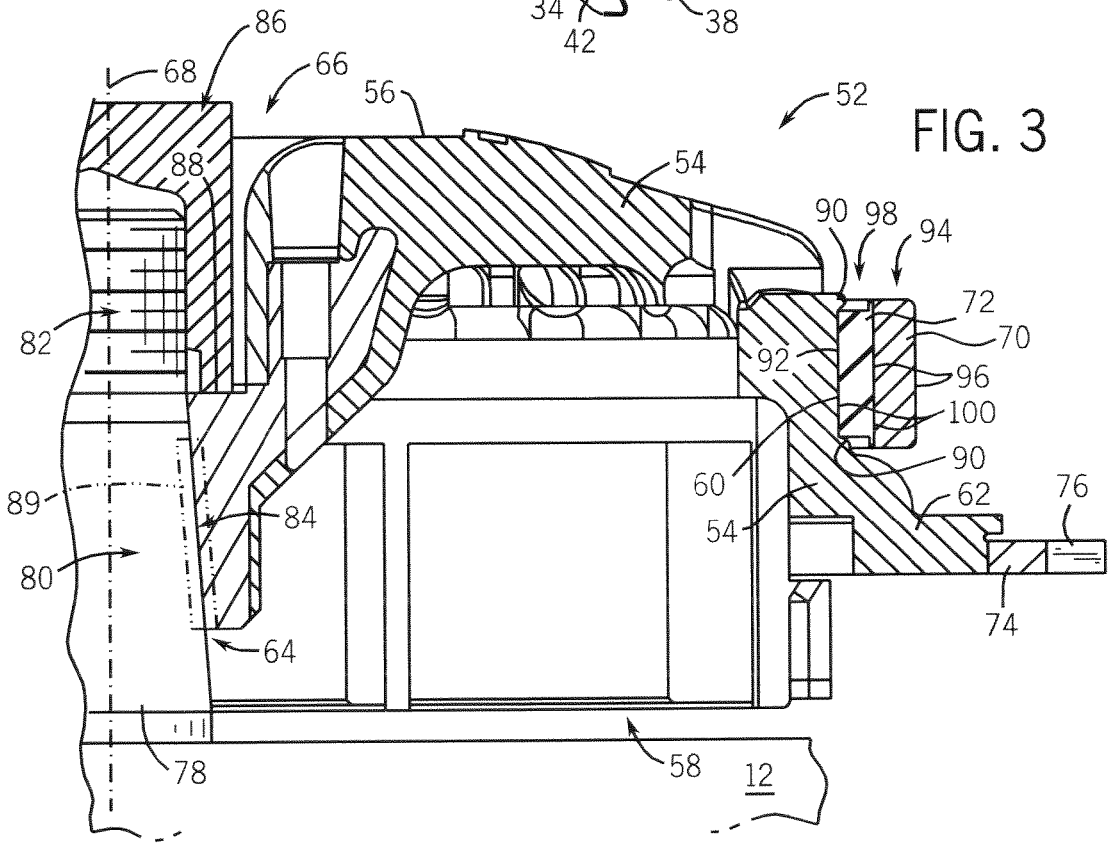
FIG. 3 is a cross-sectional view of a portion of the fly-wheel of FIG. 2.

A partial cross-section of flywheel assembly 52 is shown in FIG. 3. A crankshaft 78 attached to engine 12 passes through opening 64 of flywheel assembly 52. Crankshaft 78 has a tapered section 80 and a threaded section 82. Tapered section 80 of crankshaft 78 engages a tapered section 84 of flywheel 54. A nut 86 engages threaded section 82 of crankshaft 78 and contacts a seat 88 of fly-wheel 54 formed in opening 64, thereby compressing tapered section 82 of flywheel 54 with the tapered section 80 of crankshaft 78. A key 89, shown in phantom, is disposed between flywheel 54 and crankshaft 78 and prevents rotation of flywheel 54 relative to crankshaft 78. Such a construction maintains a secure engagement between flywheel 54 and crankshaft 78 and ensures that the flywheel is rotationally centered about the crankshaft. The tapered and keyed engagement between the flywheel and the crankshaft is shown merely by way of example and in no way limits the scope of the claims herein. Alternatively, the flywheel could be attached to the crankshaft by a single bolt threaded into a threaded opening in the center of the crankshaft or by a plurality of bolts constructed to engage a plate attached to the crankshaft.

A pair of lips 90 is formed on outer diameter 60 of fly-wheel 54 with a groove 92 formed therebetween. Elastomer ring 72 is positioned about outer diameter 60 of flywheel 54 such that it is disposed between lips 90 and in groove 92. Ring 70 is attached to flywheel 54 with elastomer ring 72 disposed therebetween. Elastomer ring 72 is thermally bonded to ring 70 with the resulting subassembly then being press-fit to flywheel 54. Such a construction isolates ring 70 from direct contact with fly-wheel 54 and thereby allows ring 70 to resonate independently of flywheel 54.

Ring 70 has a cross-section 94 that is generally rectangular in shape with a pair of longer sides 96 extending generally parallel to axis 66 of the flywheel 54. Similarly, elastomer ring 72 has a cross-section 98 that is also generally rectangular in shape with a pair of longer sides 100 generally parallel to longer sides 96 of cross-section 94 of ring 70. Such a construction provides for a secure connection between ring 70 and flywheel 54 without the use of additional fasteners.

Flywheel assembly 52 is attached to crankshaft 78 of engine 12 such that lower surface 58 of flywheel 54 faces engine 12 attached thereto. Generally, each of the respective cylinders of an engine operates much the same way. Therefore, although the present invention will be discussed only in reference to one cylinder, it is understood that the operation shares much the same relation to each cylinder of the engine. Combustion in a combustion chamber of engine 12 forces a piston and connecting rod located therein to move and rotate crankshaft 78 of engine 12. Crankshaft 78 rotates flywheel assembly 52 as the piston travels through a power stoke from approximately top dead center to bottom dead center in the combustion chamber. The momentum of flywheel assembly 52 provides a portion of the rotational force required to rotate crankshaft 78 through the compression stroke of the piston. As engine 12 operates, crankshaft 78 is repeatedly subjected to torsional loading during the combustion stroke and torsional unloading during the compression stroke.

The torsional loading and unloading of the crankshaft occurs at various frequencies. When this frequency reaches a natural resonant frequency of the engine components, the entire engine can vibrate, sometimes quite extensively. This vibration can also result in noise during operation and, if not addressed, can result in premature failure of the engine components. Ring 70 is designed to resonate at a frequency that counteracts the natural torsional frequency of the crankshaft, the flywheel, and other moving components of the engine.

In accordance with the invention, as crankshaft 78 rotates and approaches the natural torsional resonance of engine 12, ring 70 resonates at a frequency that is at a substantially equivalent frequency. Motion of ring 70 consumes a portion of the resonant vibration energy of the crankshaft and flywheel. The vibration of ring 70 substantially reduces the amplitude of the vibration of the crankshaft and flywheel assembly at its resonant frequency. As such, an engine equipped with the flywheel assembly of the present invention minimizes noise and vibration associated with torsional resonance of the crankshaft and fly-wheel.

Therefore, in accordance with one embodiment of the present invention, a flywheel assembly has a flywheel having a hub and an outer diameter and is constructed to be attached to an engine. A first ring is attached to the fly-wheel about the outer diameter. A second ring is attached to the first ring and is formed of a material that is different from that of the first ring.

In accordance with another embodiment of the present invention, a flywheel assembly has a ring having an inner surface, a flywheel having an outer surface, and an elastomer ring. The elastomer ring has a first side attached to the flywheel and a second side attached to the ring, thereby separating the ring from the fly-wheel.

In accordance with a further embodiment of the present invention, a flywheel assembly has a ring having an inner diameter and a flywheel having an outer diameter that passes through the ring. A flexible membrane is disposed between the ring and the flywheel and is constructed to prevent contact therebetween.

In accordance with yet another embodiment of the present invention, a method of offsetting natural resonance in an internal combustion engine includes the steps of determining a natural resonance of an internal combustion engine, designing a flywheel component with a natural resonance to offset the natural resonance of the internal combustion engine, and assembling the flywheel component to the internal combustion engine.

While the present invention is shown as being incorporated into an outboard motor, the present invention is equally applicable with many other applications, some of which include inboard motors, snowmobiles, personal watercrafts, all-terrain vehicles (ATVs), motorcycles, mopeds, lawn and garden equipment, generators, etc.

The present invention has been described in terms of the preferred embodiment, and it is recognized that equivalents, alternatives, and modifications, aside from those expressly stated, are possible and within the scope of the appending claims.

What is claimed is:

1. A flywheel assembly comprising:

a flywheel having a hub for mounting the flywheel to a crankshaft of an engine, the flywheel having a first outer diameter and a second outer diameter less than the first outer diameter, the first outer diameter defining a first outer surface and the second outer diameter defining a second cylindrical outer surface;

a plurality of teeth disposed about the first outer surface;

a first ring attached to the flywheel about the second outer surface; and a second ring attached to the first ring and formed of a material different from that of the first ring;

the first ring being isolated from direct contact with the flywheel by the second ring.

2. The flywheel assembly of claim 1 wherein the first ring is a ferrous material and the second ring is an elastomer material.

3. The flywheel assembly of claim 2 wherein the second ring is integrally formed to the first ring thereby forming a subassembly.

4. The flywheel assembly of claim 3 wherein the subassembly is press fit to the fly-wheel.

5. The flywheel assembly of claim 1 wherein the second ring is designed to deform to dampen vibrations generated by torsional resonance of an engine during rotation of the flywheel assembly.

6. The flywheel assembly of claim 1 incorporated into an internal combustion engine.

7. The flywheel assembly of claim 6 wherein the flywheel assembly is constructed to generate a torsional resonance that counteracts a corresponding torsional resonance of the internal combustion engine.

8. The flywheel assembly of claim 6 wherein the internal combustion engine is incorporated into a watercraft.

9. A flywheel assembly comprising:

a ring having an inner surface;

a flywheel having a first outer diameter and a second outer diameter less than the first outer diameter, the first outer diameter defining a first outer surface and the second outer diameter defining a second cylindrical outer surface, and an opening for mounting to a crankshaft of an engine;

a plurality of teeth disposed about the first outer surface; and an elastomer ring having a first side attached to the second outer surface of the flywheel and a second side attached to the inner surface of the ring thereby separating the ring from the flywheel.

10. The flywheel assembly of claim 9 wherein the elastomer ring is bonded to the inner surface of the ring.

11. The flywheel assembly of claim 9 wherein the ring is constructed to press fit onto the flywheel with the elastomer ring positioned therebetween.

12. The flywheel assembly of claim 9 wherein the teeth are constructed to engage a starter gear.

13. The flywheel assembly of claim 9 wherein the elastomer ring dampens torsional resonance of the engine.

14. The flywheel assembly of claim 9 wherein the ring is made of steel.

15. The flywheel assembly of claim 9 incorporated into an outboard motor.

16. A flywheel assembly comprising:

a ring having an inner diameter;

a flywheel having a first outer diameter and a second outer diameter less than the first outer diameter, the first outer diameter defining a first outer surface and the second outer diameter defining a second cylindrical outer surface, and an opening for mounting to a crankshaft of an engine;

the second outer diameter of the flywheel being smaller than the inner diameter of the ring;

a ring gear disposed about the first outer surface; and a flexible membrane disposed between the inner diameter of the ring and the second outer surface of the flywheel and constructed to prevent contact therebetween.

17. The flywheel assembly of claim 16 wherein the ring gear is constructed to engage a starter gear of an engine.

18. The flywheel assembly of claim 16 wherein the ring is press fit to the flywheel with the flexible membrane therebetween.

19. The flywheel assembly of claim 16 wherein the flexible membrane is an elastomer material having a resonance that dampens torsional resonance of an engine.

20. The flywheel assembly of claim 16 wherein the flexible membrane is attached to the ring.

21. The flywheel assembly of claim 16 attached to an engine incorporated into a watercraft.

22. The flywheel assembly of claim 16 attached to an engine incorporated into an outboard motor.

* * * * *